US005752394A

United States Patent [19]

Yamauchi

[11] Patent Number: 5,752,394

[45] Date of Patent: May 19, 1998

[54] APPARATUS FOR PRODUCING ICE VESSEL

[76] Inventor: Keijiro Yamauchi, at Kabushiki Kaisha Yamanouchi Seisakusho of 1-8-18, Katakura, Kanagawa-ku, Yokohama-shi, Kanagawa-ken, Japan

[21] Appl. No.: 851,231

[22] Filed: May 5, 1997

Related U.S. Application Data

[63] Continuation-in-part of Ser. No. 515,474, Aug. 15, 1995, Pat. No. 5,634,344.

[30] Foreign Application Priority Data

Sep. 30, 1994 [JP] Japan ..... 6-237792
Jun. 27, 1995 [JP] Japan ..... 7-161044

[51] Int. Cl.[6] ..... F25C 5/14

[52] U.S. Cl. ..... 62/341; 425/373

[58] Field of Search ..... 62/75, 341; 264/28; 425/373

[56] References Cited

U.S. PATENT DOCUMENTS

| | | | |
|---|---|---|---|
| 530,526 | 12/1894 | Holden | 62/341 |
| 1,937,174 | 11/1933 | Taylor | 62/75 |
| 2,837,043 | 6/1958 | Grice et al. | 425/373 |
| 3,999,914 | 12/1976 | Breher et al. | 425/373 |
| 4,515,549 | 5/1985 | Yang | 425/373 |
| 4,571,320 | 2/1986 | Walker | 425/139 |
| 4,686,076 | 8/1987 | Dromigny et al. | 425/444 |
| 4,755,128 | 7/1988 | Alexander et al. | 425/422 |
| 4,780,119 | 10/1988 | Brooke | 62/341 |
| 4,920,762 | 5/1990 | Beckstead et al. | 425/412 |
| 4,965,027 | 10/1990 | Takahashi | 264/28 |
| 5,069,044 | 12/1991 | Holum et al. | 62/341 |
| 5,372,492 | 12/1994 | Yamauchi | 425/139 |
| 5,419,138 | 5/1995 | Anderson et al. | 62/341 |
| 5,548,960 | 8/1996 | Anderson et al. | 62/341 |

*Primary Examiner*—William E. Tapolicai
*Attorney, Agent, or Firm*—Quarles & Brady

[57] ABSTRACT

An apparatus for automatically producing ice vessels. Ice masses produced by ice making machine 3 is crushed to pieces by ice crusher 1. Then, the ice pieces are fed from an outlet chute 2A of the ice crusher 1 to one of female dies 12, which are provided on an endless conveyor 11. A plurality of male dies 15 are integrally provided around an outer periphery of a rotary plate 31. With the intermittent movement of the conveyor 11 and the rotation of the rotary plate associated therewith, the male dies 15 are sequnetially inserted into the female dies 12 to mold ice vessels A, which are then transported to a terminal side 11A, where they are detached from the female dies 12 by a collecting plate 21 and then transported thereon. According to the invention, there can be provided an apparatus which can make ice in proper quantities and is suited for mass production of ice vessels.

8 Claims, 3 Drawing Sheets

APPARATUS FOR PRODUCING ICE VESSEL

CROSS REFERENCE TO RELATED APPLICATIONS

This application is a continuation-in-part application of U.S. Ser. No. 08/515,474 filed on Aug. 15, 1995, now U.S. Pat. No. 5,634,344.

BACKGROUND OF THE INVENTION

1. Field of the Invention

The present invention relates to an apparatus for forming ice pieces into ice vessels for dishing up or covering food such as vegetable salad, sashimi or the like.

2. Description of Prior Art

In the past, an apparatus for producing ice vessel for vegetable salad or the like has been proposed in Japanese Patent Application Un-Examined Publication No.6-194018, of which the columns 1 and 2 disclose an apparatus for producing ice vessels comprising a female die, a male die opposite to said female die for cooperating with said female die to define a mold cavity for forming said ice vessels, a through-hole formed at the bottom of said female die, a pushing-out pin which is raised and lowered in said through-hole by an elevator device, a chute box for feeding ice pieces from suitable ice crusher into said female die, said chute box having an outlet located above said female die and an inlet located below said ice crusher for receiving ice pieces therefrom, a carrier-arm device provided above said female die. The prior apparatus for producing ice vessels is operated in such a manner that relatively large masses of ice pieces fed from an ice making machine are crushed by the ice crusher and then supplied to the female die through the chute box, which are molded by the male die cooperating with the female die, so that molded ice vessels are taken out by the pushing-out pin raised by the elevator device, which are subsequently transported by the carrier arm device.

Such molded ice vessels are generally served for guests of a hotel or an inn, either with vegetable salad or sashimi accommodated therein to keep them cool or with such food dished up in a vessel in advance covered therewith.

According to the prior art, ice masses are ceaselessly supplied from the ice making machine to the ice crusher, which are subsequently crushed thereby to be yet ceaselessly fed into the female die. However, such production process of ice pieces cannot meet needs for constant ice volume required for producing one ice vessel, so that it has been difficult to supply ice pieces in proper quantities.

Furthermore, according to the prior art, as molded ice vessels have to be taken out one by one by means of the pushing-out pin, so that it cannot realize a mass production of ice vessels.

SUMMARY OF THE INVENTION

Accordingly, it is a main object of the present invention to provide an apparatus for producing ice vessels which can make ice in proper quantities.

It is another object of the present invention to provide an apparatus for producing ice vessels which can realize mass production of ice vessels.

In accordance with a major feature of the present invention, there is provided an appparatus for producing ice vessel comprising: an ice making machine; an ice crusher for crushing ice masses supplied from said ice making machine, said ice crusher having an outlet chute; a plurality of female dies for accommodating crushed ices thereinto, said female dies being provided on an endless conveyor; a rotary body having a plurarity of male dies provided thereon, one of said male dies being opposite to said female dies when the rotary body is rotated.

BRIEF DESCRIPTION OF THE DRAWINGS

Other objects, features and advantages of the invention will be apparent to those skilled in the art from the following description of the preferred embodiment of the invention, wherein reference is made to the accompanying drawings, of which.

DESCRIPTION OF PREFERRED EMBODIMENTS

Figure 1:
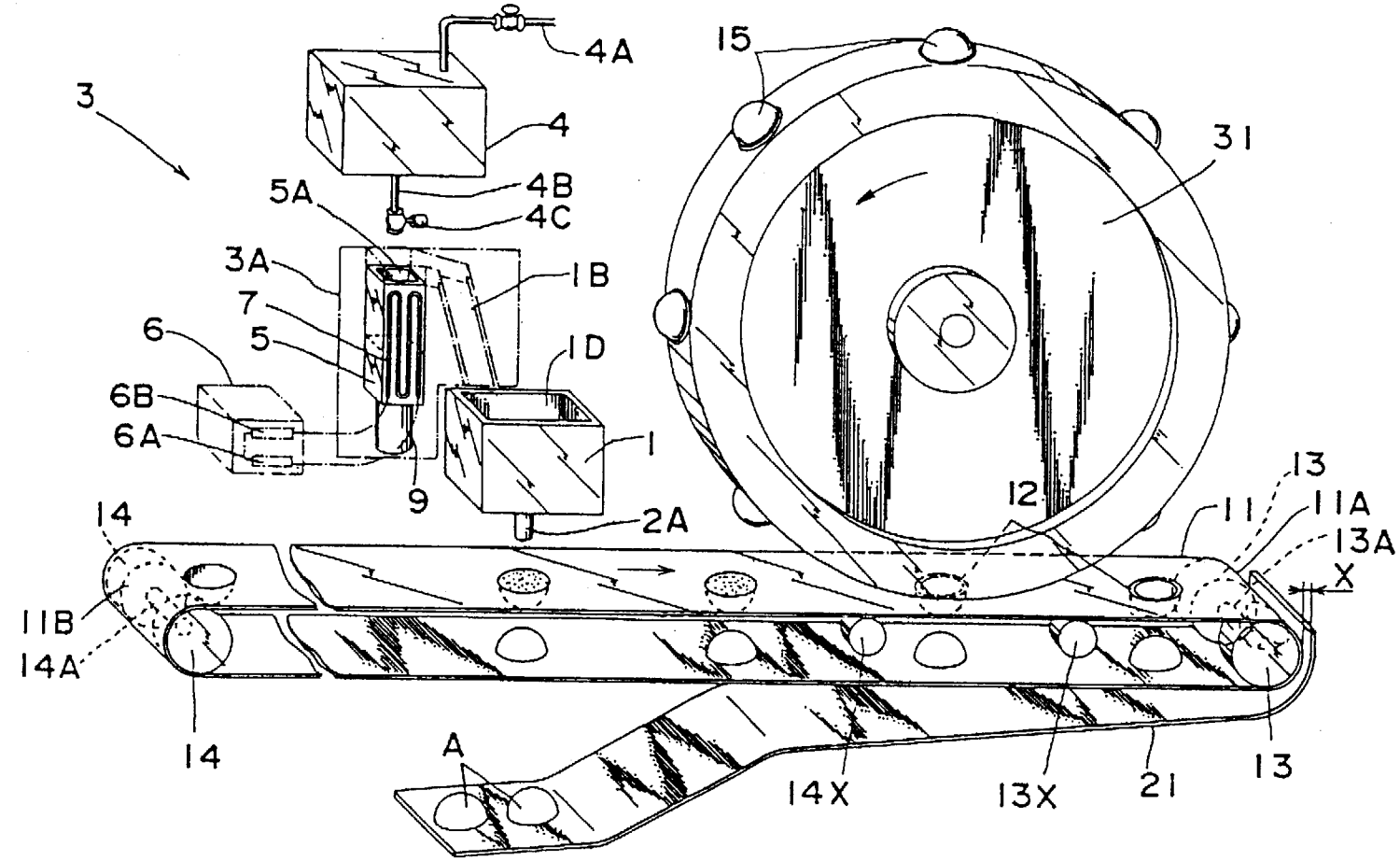
FIG. 1 is a perspective view showing a general structure of an embodiment of the invention.
Figure 2:
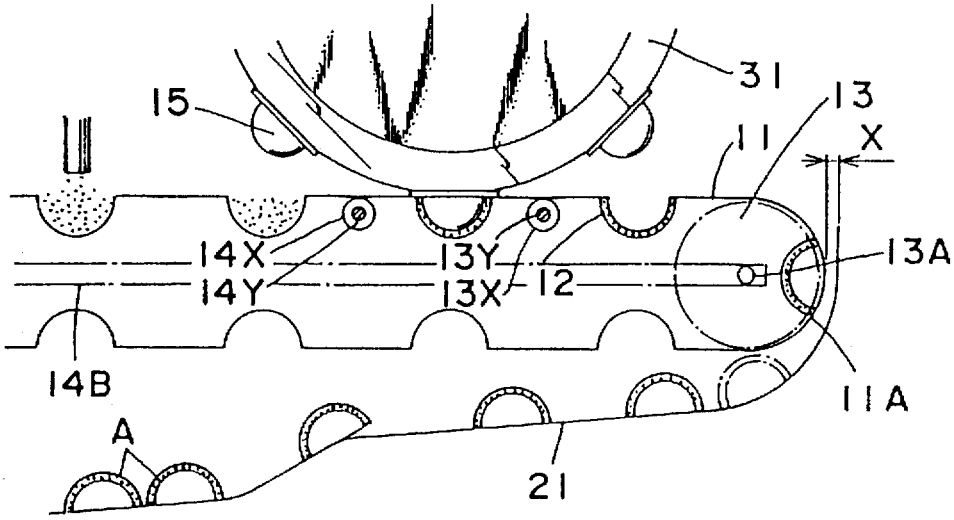
FIG. 2 is a section showing a main part of the embodiment of the invention.

Hereinafter is described an embodiment of the present invention with reference to FIGS. 1 to 4.

In the drawings, reference numeral 1 designates automatic ice crusher, having outlet chute 2A.

Figure 3:
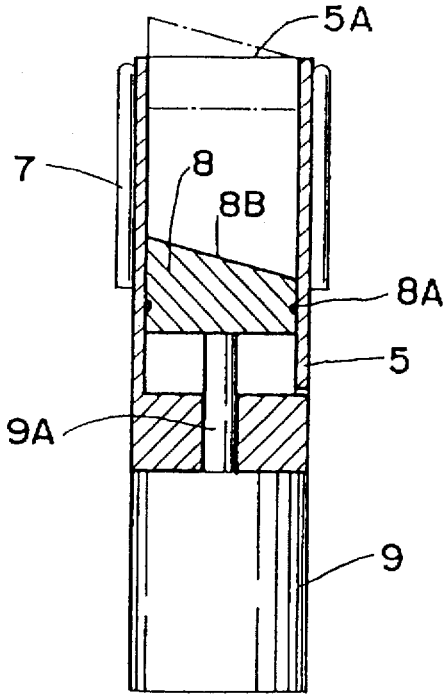
FIG. 3 is a section showing an ice making box of the embodiment of the invention.
Figure 4:
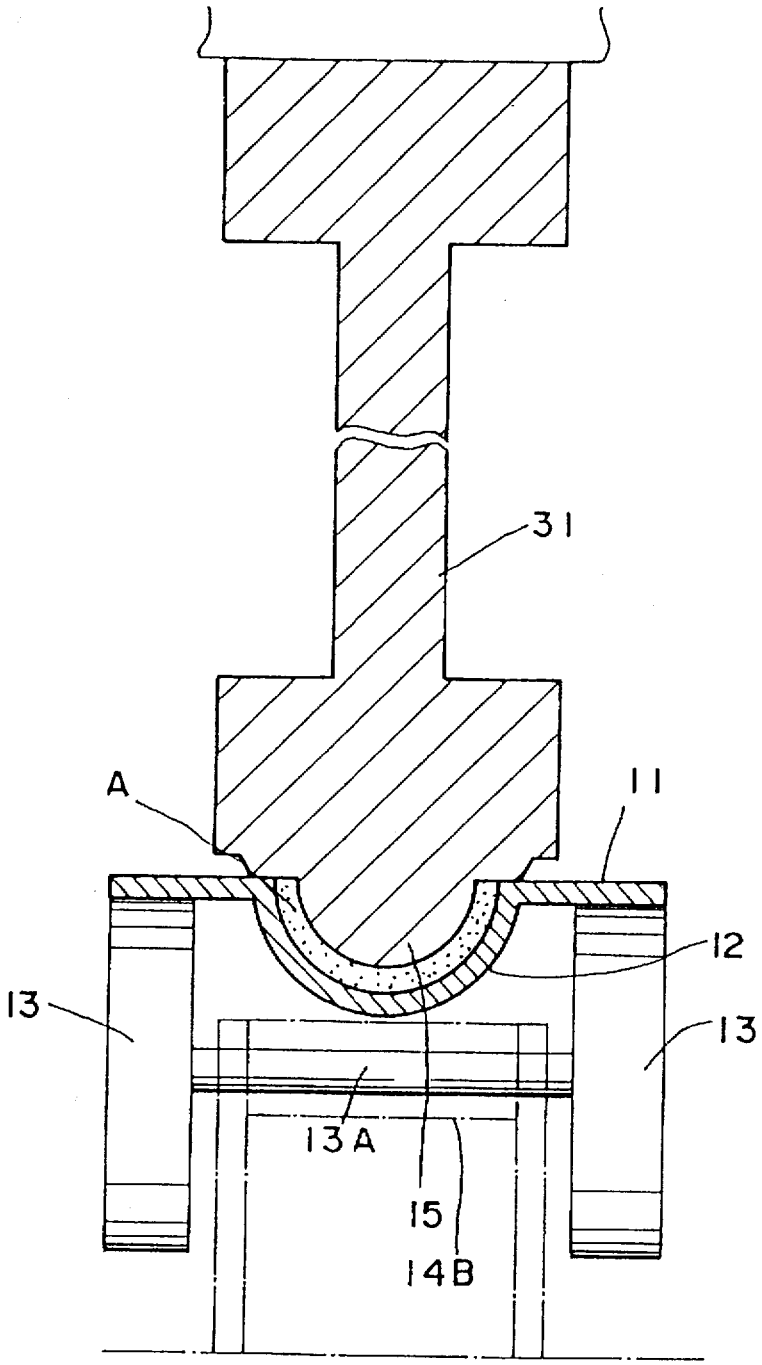
FIG. 4 is a section showing a rotary plate of the embodiment of the invention.

Water cooler 4 disposed above has a refrigerating machine (not shown) and holds constant a water level of water supplied from water pipe 4A and keeps the same cold, preferably within a range from 0 to 4 degs centigrade, having supply port 4B equipped with automatic closing valve 4C, thus providing feed-water line for ice making box 5, which has an upper aperture 5A opposite to the supply port 4B to receive the cold water. To a periphery of the ice making box 5 is secured evaporator 7 formed from a meandering pipe, which is connected to refrigeration unit 6 across a flexible pipe. The refrigeration unit 6 has built-in motor-driven compressor 6A and condenser 6B. At a bottom of the ice making box 5 is slidably provided pushing-out pin 8, which is provided with pneumatic or hydraulic cylinder 9 mounted on a lower surface of the bottom, having a rod 9A which penetrates through the bottom of the ice making box 5 to connect to the pushing-out pin 8. An inner surface of the ice making box 5 and a surface of the pushing-out pin 8 are each coated with fluororesin layer (not shown), while around a peripheral surface of the pin 8 is provided 0-ring 8A for watertight purpose, said pin 8 having inclined upper surface 8B as illustrated in FIG. 3. Reference numeral 1B designate guide plate provided adjacent the inclined side of the surface 8B, while reference numeral 3A heat insulating chamber.

Reference numeral 11 designates endless conveyor made of flexible resin or rubber such as elastomer or the like. The surface of conveyor 11 is spacedly formed with a plurality of hemispherical concave portions to form female dies 12 for molding ice vessels A respectively. There is provided driving roller 13 driven by a motor (not shown) at one side of the conveyor 11, while driven roller 14 at the other side thereof. These rollers 13 and 14 have shafts 13A and 14A connected thereto in the centers thereof respectively, which are rotatably supported by frame 14B. Reference numerals 13X and 14X designate guide rollers respectively, each having shaft 13Y or 14Y connected to frame 14B.

Reference numeral 21 designates collecting plate for collection of the molded ice vessels A which is provided at the terminal station side 11A of conveyor 11. The distance X between the conveyor 11 and the collecting plate 21 is relatively small at terminal side 11A, which gradually increases toward the other side.

Further, there is provided rotary plate 31 of a large diameter which is positioned above terminal station 11A side of endless conveyor 11 having plural female dies 12. The rotary plate 31 has a plurality of male dies 15 integral therewith around its outer periphery. Each interval between the adjacent female dies 12 is set equal to each arc length between the adjacent male dies 15 on the rotary plate 31. A motor for drive of driving roller 13 and another motor for drive of rotary plate 31 are each so controlled that male dies 15 are fitted into the female dies 12 in sequence.

The endless conveyor 11 is intermittently moved until it reaches the terminal side 11A, where the conveyor 11 is arc-shaped, thus detaching molded ice vessels from the female dies 12, then carriying them onto collecting plate 21. Then, the molded ice vessels A are transported in sequencce toward other side due to the inclination of the collecting plate 21, for storage.

Hereinafter is described an action of the above-structured apparatus.

The actuation of the controller device (not shown) allows cold water to be supplied from water cooler 4 to ice making box 5 in the erected position with a quantitiy thereof being adjusted to be nearly equal to that required for producing one ice vessel A by automatic closing valve 4C controlled by a timer (not shown). The cold water is then further cooled within ice making box 5 to produce ice masses. Thereafter, cylinder device 9 is worked to raise pushing-out pin 8 slightly above upper aperture 5A. Thus, the ice masses are pushed out to be fed into inlet port 1D, sliding along the slope of guide plate 1B, which are then crushed by automatic ice crusher 1 to 2 to 5 mm-sized pieces, thereby allowing the obtained ice pieces to be accommodated through outlet chute 2A into female dies 12 in sequence.

With intermittent movement of endless conveyor 11 and rotation of rotary plate 31 associated therewith, male dies 15 are sequently fitted into female dies 12, thus forming the ice pieces within female die 12 into an ice dish. With further movement of endless conveyor 11 and further rotation of rotary plate 31, the fitted male dies 15 are separated from female dies 12. When the molded ice vessels A in the female dies 12 arrive at terminal station 11A where endless conveyor is arc-shaped, they are removed from female dies 12, and carried onto collecting plate 21, which is inclined so that the ice vessels A can be shifted to other side for storage, as shown in FIG. 1.

According to an embodiment of the invention, there is provided an apparatus for producing ice vessel, comprising an endless conveyor 11 having a plurality of female dies 12, an automatic ice crusher 1 having an outlet chute 2A opposite to one of the female dies 12, a rotary plate 31 having a plurality of male dies 15 integral therewith around its outer periphery, whereby the intermittent movement of the conveyor 11 is associated with the feeding of ice pieces from the outlet chute 2A into the female dies 12, thus successively forming the accommodated ice pieces into ice vessels A.

Specifically, with the rotation of the rotary plate 31 having the male dies 15 around the outer periphery thereof, the male dies 15 are automatically inserted into the female dies 12, thus ensuring the molding. It should be noted that a plurality of the male dies 15 provided around the rotary plate 31 enables the appparatus to perform plural ice-moldings during one rotation of the rotary plate 31.

Further, as each interval between adjacent female dies 12 is set equal to that between the adjacent male dies 15 provided around the outer periphery of the rotary plate 31, the movement of the conveyor 11 can be synchronized to the rotation of the rotary plate 31, thus successively molding ice vessels A.

Seen from another aspect of the invention, there is provided an apparatus for producing ice vessel, comprising an ice making machine 3 which comprises: an ice making box 5 having a cold water supply port 4B, an evaporator 7 provided in the ice making box 5, a refrigerant compressor 6A and condensor 6B connected to the evaporator 7; an ice pieces pushing-out pin 8, said pin 8 being capable of reciprocating within said ice making box 5, whereby the ice making box 5 having cold water accommodated therein can be directly cooled to intermittently produce ice masses, so that the production of ice vessels A can be quickly started.

Specifically, as the volume of the ice making box 5 corresponds to that for required when producing one ice vessel A, the ice-making, crushing, molding and transporting of ice vessels can be carried out in sequence per a unit quantitiy for making ice, thereby efficiently making ice.

Further, owing to the collecting plate 21 provided at the terminal side 11A of the conveyor 11, the recovering of the molded ice vessels A can be efficiently carried out by receiving the molded ice vessels A when they are detached from the female dies 12 due to the inverting motion thereof at the terminal side 11A. Additionally, the collecting plate 21 is tabular, thereby allowing the dish-like ice vessels A to be stably carried thereon. In addition, as the distance X between the conveyor 11 and the collecting plate 21 is relatively small at the terminal side 11A, which gradually increases toward the other side, the production of ice vessels A can be ensured without the fear of damaging the detached ice vessels A when recovering the same.

In addition, owing to the inclination of the upper surface 8B of the pushing-out pin 8 and the guide plate 1B, the feeding of ice masses into the inlet port ID is ensured in such a manner that the ice masses are allowed to slide along the inclination to be fed into the port ID when pushing out the ice masses within the ice making box 5.

Incidentally, the present invention should not be limited to the foregoing embodiment, but may be modified within a scope of the invention. For example, the configuration of dies may be changed to mold tabular ice vessels. The endless conveyor having a plurality of female dies may be made of suitable metal such as stainless steel. Further, metallic female dies may be provided on a part of a rubber-made endless conveyor for the benefit of improvement of durability.

What is claimed:

1. An apparatus for producing ice vessels comprising:

an ice making machine;

an ice crusher for crushing ice masses supplied from said ice making machine, said ice crusher having an outlet chute;

a plurality of female dies for accommodating crushed ices thereinto, said female dies being provided on an endless conveyor;

a rotary body;

a plurarity of male dies provided on said rotary body, said male dies being opposite to said female dies when said rotary body is rotated.

2. An apparatus for producing ice vessels according to claim 1, wherein said male dies are provided around an outer periphery of said rotary body.

3. An apparatus for producing ice vessels according to claim 2, wherein intervals between said adjacent female dies are each equal to those between said adjacent male dies provided around an outer periphery of said rotary body.

4. An apparatus for producing ice vessels according to claim 1, wherein said ice making machine comprises:

an ice making box;

an evaporator provided in said ice making box;

a refrigerant compressor and condenser connected to the evaporator; and an ice pieces pushing-out pin, said pin being capable of reciprocating within said ice making box.

5. An apparatus for producing ice vessels according to claim 1, further comprising a collecting body provided at an terminal side of said endless conveyor.

6. An apparatus for producing ice vessels according to claim 1, wherein said females dies are formed concave, while said male die formed convex.

7. An apparatus for producing ice vessels according to claim 4, wherein said ice making box has a volume substantially equal to that of one of said female dies.

8. An apparatus for producing ice vessels according to claim 5, wherein said collecting body is tabular, a distance between said collecting body and said endless conveyor being smaller at said terminal side thereof relative to other portions.

* * * * *